US007855704B2

(12) United States Patent
Yoshimoto

(10) Patent No.: US 7,855,704 B2
(45) Date of Patent: Dec. 21, 2010

(54) LIQUID CRYSTAL DEVICE, CONTROL CIRCUIT THEREFOR, AND ELECTRONIC APPARATUS

(75) Inventor: Hiroshi Yoshimoto, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 921 days.

(21) Appl. No.: 11/733,578

(22) Filed: Apr. 10, 2007

(65) Prior Publication Data

US 2007/0247410 A1 Oct. 25, 2007

(30) Foreign Application Priority Data

Apr. 24, 2006 (JP) ..... 2006-119125
Jun. 21, 2006 (JP) ..... 2006-171523

(51) Int. Cl.
*G09G 3/36* (2006.01)

(52) U.S. Cl. ..... 345/87; 345/98

(58) Field of Classification Search ..... 345/87–102, 345/204, 38, 50
See application file for complete search history.

(56) References Cited

U.S. PATENT DOCUMENTS 5,448,260 A * 9/1995 Zenda et al. ..... 345/100
2004/0183769 A1* 9/2004 Schreyer et al. ..... 345/99
2005/0062733 A1* 3/2005 Morita ..... 345/204
2005/0099379 A1* 5/2005 Iisaka ..... 345/100

FOREIGN PATENT DOCUMENTS

JP A-2004-177930 6/2004

* cited by examiner

*Primary Examiner*—Kevin M Nguyen
*Assistant Examiner*—Kenneth B Lee, Jr.
(74) *Attorney, Agent, or Firm*—Oliff & Berridge, PLC

(57) ABSTRACT

A liquid-crystal-device control circuit includes pixels corresponding to intersections between scanning lines in rows and data lines in columns, a counter that counts the number of horizontal lines included in a video signal supplied correspondingly to a region broader than pixels corresponding to the scanning lines in the rows, a determination circuit that determines which is greater between the number of horizontal lines counted by the counter and a value stored in a predetermined register, an addition/subtraction circuit that, depending on a result of determination by the determination circuit, adds a predetermined number to or subtracts the predetermined number from the value stored in the register, and a scanning control circuit which stores the value obtained by the addition/subtraction circuit in the register, and which defines start timing of the second field on the basis of the value stored in the register.

7 Claims, 11 Drawing Sheets

1
10
DISPLAY PANEL
50
DX
CLX
$V_{id}$
DY
CLY
Enb1
Enb2
CLc
(NUMBER OF LINES) COUNTER
53
CMP
59
F
55
+2/-2
57
REGISTER
PLc
SCANNING CONTROL CIRCUIT
51
VIDEO SIGNAL PROCESSING CIRCUIT
60
RAM
62
$V_{sync}$
$H_{sync}$
$D_{clk}$

LIQUID CRYSTAL DEVICE, CONTROL CIRCUIT THEREFOR, AND ELECTRONIC APPARATUS

BACKGROUND

1. Technical Field

The present invention relates to a technology for preventing image sticking in a case in which a so-called "region-scanning driving method" is employed in a liquid crystal device.

2. Related Art

In recent years, projectors which use liquid crystal devices to form small images and which use optical systems to project images formed by enlarging the small images have been in widespread use. In a liquid crystal device for forming a small image, so-called "disclination (misorientation)" can be a problem since a distance between pixels is very small. The disclination can be avoided by employing in-plane inversion (also called "frame inversion") in which pairs of two adjacent pixels are set to have the same polarity. However, the in-plane inversion has a problem in that, for example, top and bottom ends on a displayed screen have a display difference.

To eliminate the display difference, so-called "region-scanning driving" (see, for example, JP-A-2004-177930) has been proposed. In the region-scanning driving, by dividing the period of a frame into, for example, first and second fields, and performing positive voltage writing to each pixel in either field, and performing negative voltage writing to the pixel in the other field, the percentages of positive-voltage-holding pixels and negative-voltage-holding pixels in one row of pixels are each 50 percent.

A projector of the above type can De connected to various types of image sources such as a personal computer and a television receiver. Image signals (video signals) supplied from the image sources differ for each image source in terms of, for example, the number of horizontal lines. If a driving method of the related art is employed in a liquid crystal device, the driving method only needs to convert a supplied image signal into a form adapted for driving pixels of the liquid crystal device. However, when the above region-scanning driving is employed, the following problem occurs. Specifically, in a case such as switching of image sources, when a pixel is noted, a period in which the pixel holds a positive voltage and a period in which the pixel holds a negative voltage have a difference, so that a DC (direct current) component is applied to cause liquid crystal of the pixel to deteriorate.

Similarly to sticking occurring on a fluorescent screen of a CRT (cathode-ray tube), due to deterioration in liquid crystal, a fixed image unrelated to an image to be displayed may appear. Accordingly, similarly to the case of the CRT, this display phenomenon caused by deterioration in liquid crystal is also called "sticking".

SUMMARY

An advantage of some aspects of the invention is to provide a liquid crystal device, control circuit, and electronic apparatus for preventing sticking that may occur when region-scanning driving is employed.

According to an aspect of the invention, there is provided a liquid-crystal-device control circuit including a plurality of pixels corresponding to intersections between scanning lines in a plurality of rows and data lines in a plurality of columns, each pixel having a grayscale level based on a data signal supplied to one data line when each scanning line is selected;

a scanning line driving circuit that, in first and second fields obtained by dividing the period of a frame, selects the plurality of scanning lines by performing: in one field of the first and second fields, first selection for selecting a scanning line in one row, the selected scanning line serving as a base; second selection for selecting a scanning line which is m rows away in one direction from the scanning line selected in the first selection, where m represents an integer not less than 2; third selection for selecting a scanning line which is (m+1) rows away in an opposite direction from the scanning line selected in the second selection; and alternate repetition of the second selection and the third selection; and, in the other field of the first and second fields, fourth selection for selecting a scanning line in one row, the selected scanning line serving as a base; fifth selection for selecting a scanning line which is m rows in the opposite direction from the scanning line selected in the fourth selection; sixth selection for selecting a scanning line which is (m−1) rows away in the one direction from the scanning line selected in the fifth selection; and alternate repetition of the fifth selection and the sixth selection; a data-line driving circuit which supplies, to the data lines in the plurality of columns, a data signal having a voltage based on a grayscale level of one pixel corresponding to each scanning line selected, and in which, when the scanning line is selected in each of the first selection, the third selection, and the fifth selection, the voltage of the data signal is set to be higher or lower than a predetermined reference voltage, and, when the scanning line is selected in each of the second selection, the fourth selection, and the sixth selection, the voltage of the data signal is set to be higher or lower than the predetermined reference voltage, a counter that counts the number of horizontal lines included in a video signal supplied correspondingly to a region broader than pixels corresponding to the scanning lines in the plurality of rows, a determination circuit that determines which is greater between the number of horizontal lines counted by the counter and a value stored in a predetermined register, an addition/subtraction circuit that, depending on a result of determination by the determination circuit, adds a predetermined number to or subtracts the predetermined number from the value stored in the register, and a scanning control circuit which stores the value obtained by the addition/subtraction circuit in the register, and which defines start timing of the second field on the basis of the value stored in the register.

According to an embodiment of the invention, in the periods of a plurality of frames, for each pixel, a period in which a positive voltage is held and a period in which a negative voltage is held are balanced. Thus, application of a DC component to liquid crystal can be prevented.

It is preferable that, when the determination circuit determines that the number of horizontal lines counted by the counter is greater than the value stored in the register, the addition/subtraction circuit add the predetermined number to the value stored in the register, and, when the determination circuit determines that the number of horizontal lines counted by the counter is less than the value stored in the register, the addition/subtraction circuit subtract the predetermined number from the value stored in the register.

It is preferable that, when the number of horizontal lines counted by the counter is equal to the value stored in the register, the addition/subtraction circuit maintain the value stored in the register.

It is preferable that, when the predetermined number is added to the value stored in the register, the scanning control circuit delay the start timing of the second field than predetermined timing, and, when the predetermined number is subtracted from the value stored in the register, the scanning control circuit advance the start timing of the second field than the predetermined timing.

It is preferable that the scanning line driving circuit select the scanning lines in the plurality of rows on the basis of a shift signal obtained by shifting start pulses on the basis of a clock signal, and it is preferable that the scanning control circuit define the start timing of the second field by delaying or advancing supply timing of the start pulses for the clock signal.

Embodiments of the invention can be conceptualized not only as a liquid-crystal-device control circuit, but also as a liquid crystal device itself, and, in addition, as an electronic apparatus including the liquid crystal device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
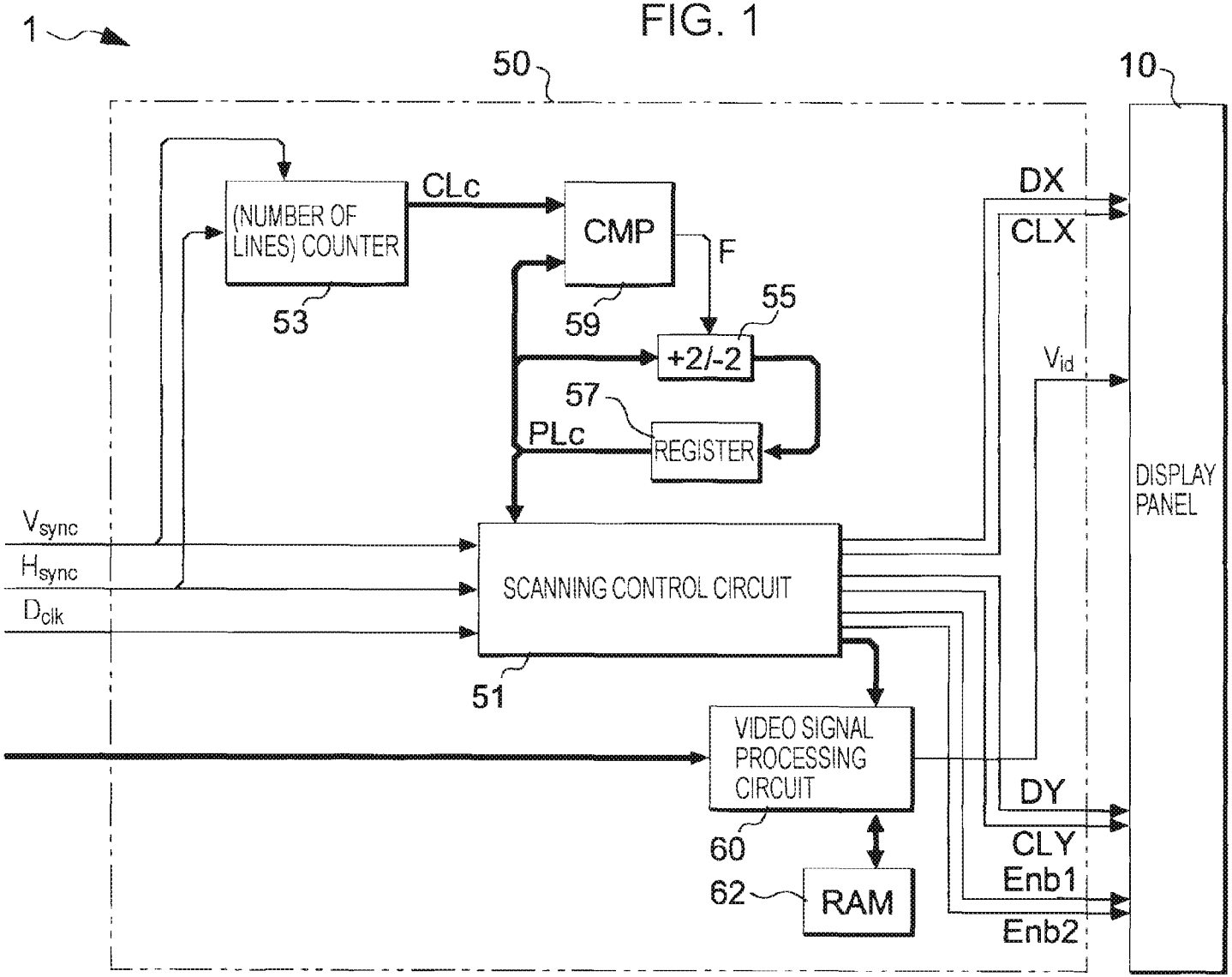
FIG. 1 is a block diagram showing the configuration of a liquid crystal device according to an embodiment of the invention.

An embodiment of the invention is described below with reference to the accompanying drawings. FIG. 1 is a block diagram showing the configuration of a liquid crystal device 1 according to the embodiment. As shown in FIG. 1, the liquid crystal device 1 is broadly divided into a display panel 10 and a processing circuit 50. The processing circuit 50 is a circuit module for controlling an operation, etc., of the display panel 10. The processing circuit 50 is connected to the display panel 10 by, for example, an FPC (flexible printed circuit) substrate.

Figure 2:
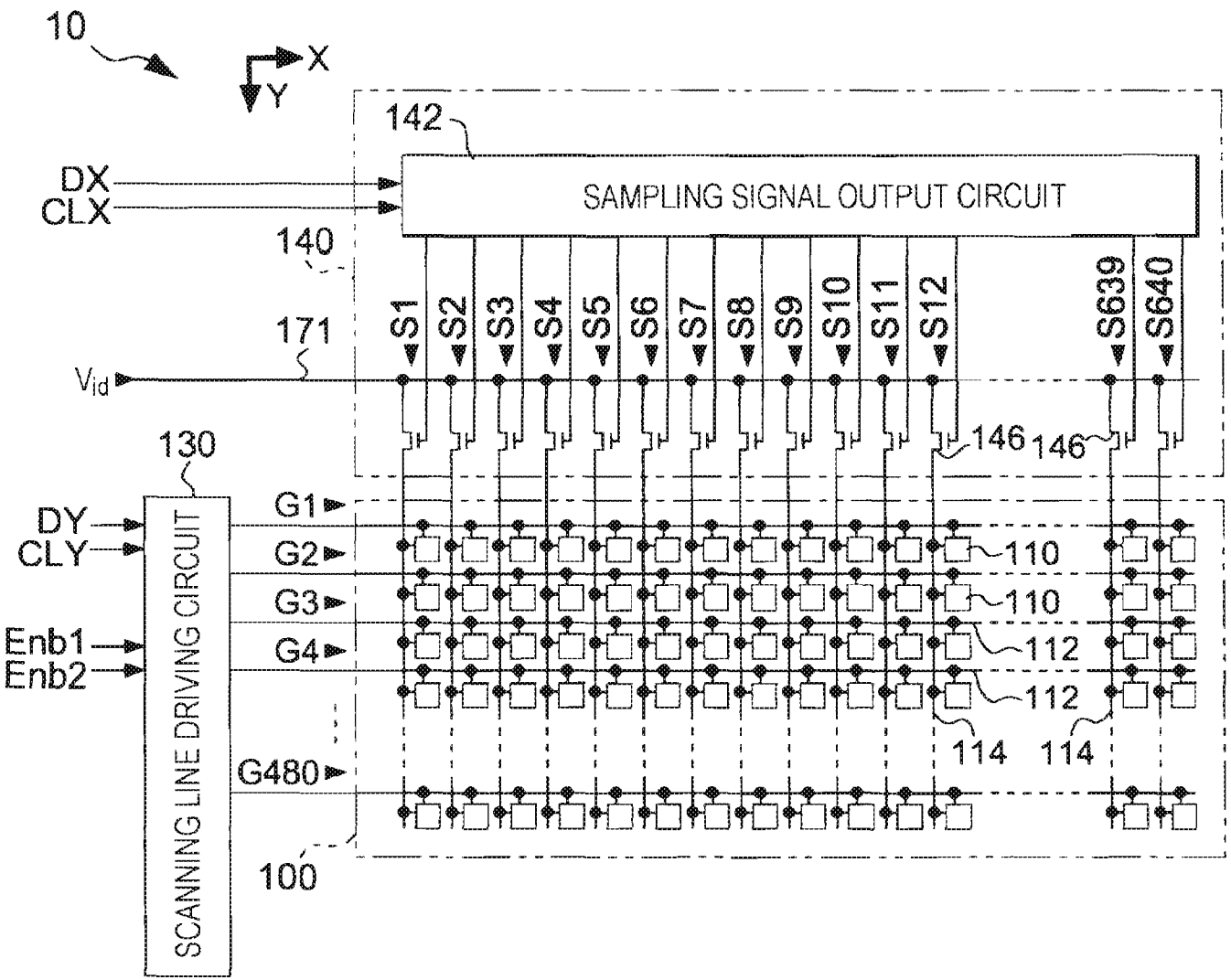
FIG. 2 is a circuit diagram showing the configuration of a display panel in the liquid crystal device shown in FIG. 1.

As shown in FIG. 2, the display panel 10 has built-in peripheral circuits. Specifically, the display panel 10 includes a scanning line driving circuit 130 and a data line driving circuit 140 that are provided around a display region 100. In the display region 100, 480 scanning lines 112 extend in a row direction (X-direction). 640 data lines 114 extend in a column direction (Y-direction), with them electrically insulated from the scanning lines 112. In addition, pixels 110 are arranged correspondingly to intersections between the scanning lines 112 and the data lines 114. Accordingly, in this embodiment, the pixels 110 are arranged in the form of a matrix having 480 rows and 640 columns. However, an embodiment of the invention is not limited to this arrangement.

Figure 3:
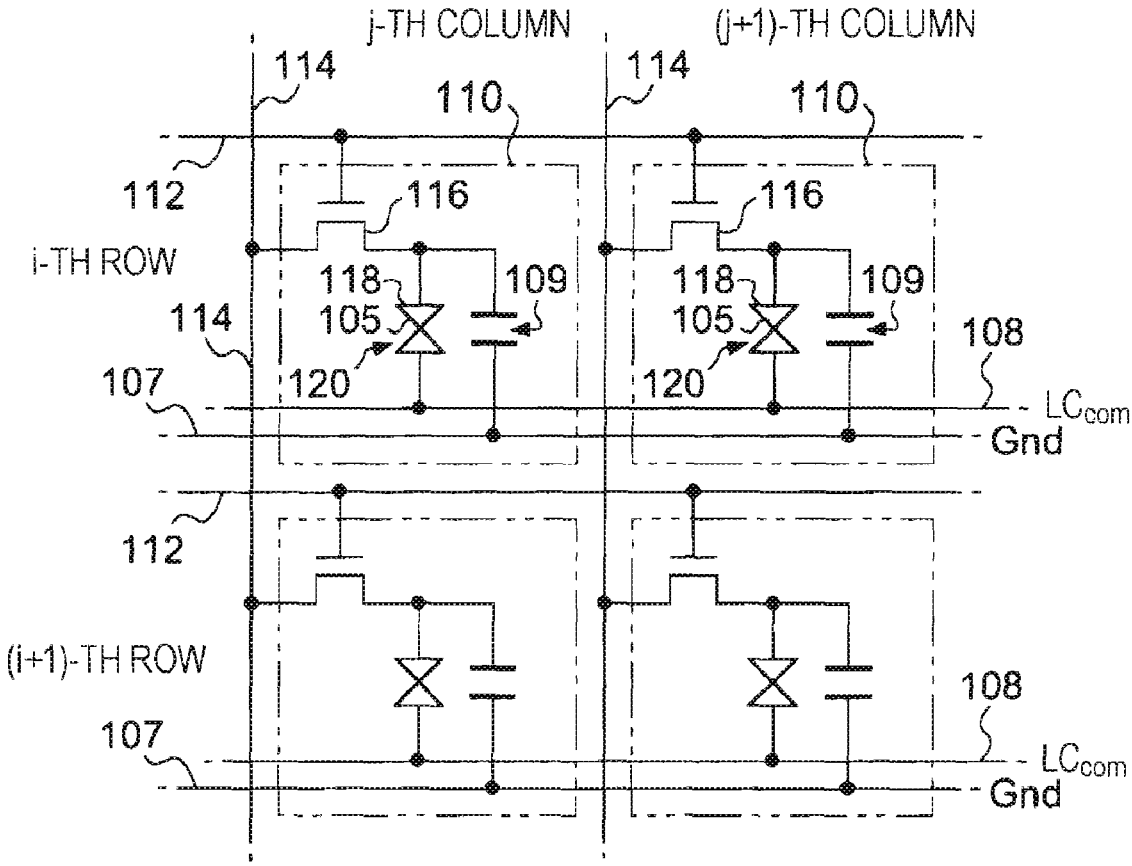
FIG. 3 is a circuit diagram showing the configuration of each pixel in the liquid crystal device in FIG. 1.

The configuration of the pixels 110 is described below with reference to FIG. 3. FIG. 3 shows a configuration for a total of four (2 by 2) pixels corresponding to intersections of the i-th row, the (i+1)-th row that is adjacently lower than the i-th row, the j-th column, and the (j+1)-th column that is adjacently right therefrom. The symbols i and (i+1) are used to generally represent rows in which the pixels 110 are arranged. The symbols j and (j+1) are used to generally represent columns in which the pixels 110 are arranged.

As shown in FIG. 3, each pixel 110 includes an n-channel TFT (thin film transistor) 116 and a liquid crystal capacitor 120. Since the pixels 110 are identical to one another in configuration, a pixel 110 positioned in the i-th row and the j-th column is described as a representation. The TFT 116 in th-e pixel 110 in the i-th row and the j-th column has a gate connected to a scanning line 112 in the i-th row, a source connected to a data line 114 in the j-th column, and a drain connected to a pixel electrode 118 that is an end of the liquid crystal capacitor 120. The other end of the liquid crystal capacitor 120 is a common electrode 108. The common electrode 108 is common to all the pixels 110. A predetermined voltage, represented by $LC_{com}$, is temporally applied to the common electrode 108.

The display panel 10 has a pair of substrates, that is, an element substrate and counter substrate (not shown) bonded to each other, having a predetermined gap therebetween, with liquid crystal 105 provided in the gap. On the element substrate, the scanning lines 112, the data lines 114, the TFTs 116, the pixel electrodes 118, the scanning line driving circuit 130, and the data line driving circuit 140 are formed, while, on the counter electrode, the common electrodes 108 are formed. Both substrates are bonded to each other having the predetermined gap so that both electrode-formed surfaces oppose each other. Accordingly, in this embodiment, the liquid crystal capacitor 120 is formed such that the pixel electrode 118 and the common electrode 108 have the liquid crystal 105 therebetween.

In this embodiment, for brevity of description, the display panel 10 is set to a normally white mode in which, when an effective voltage value in the liquid crystal capacitor 120 is close to zero, a transmittance of light passing through the liquid crystal capacitor 120 is maximum, thus causing the display panel 10 to display white, while, as the transmittance of the light increases, the effective voltage value decreases, thus finally causing the display panel 10 to display black in which the transmittance is minimum.

In this configuration, by applying a selective voltage to the scanning line 112 to set the TFT 116 to an on-state (conductive state), and applying a voltage corresponding to a grayscale (brightness to the pixel electrode 118 through the data line 114 and the TFT 116, which is in the on-state, the liquid crystal capacitor 120 can hold an effective voltage corresponding to the grayscale.

Although the TFT 116 is set to an off-state (non-conductive state) when the scanning line 112 has a non-selection voltage, electric charge stored in the liquid crystal capacitor 120 leaks, to no small extent, since an off-resistance in the off-state is not always ideally infinite. To reduce an effect of the leak in the off-state, a storage capacitor 109 is formed for each pixel. Ends of the storage capacitors 109 are connected to (the drains of the TFT 116 in) the pixel electrodes 118, while the other ends of the storage capacitor 109 are connected in common to capacitance lines 107 for all the pixels 110. Each capacitance line 107 is maintained to have a temporally predetermined potential, for example, ground potential Gnd. The scanning line driving circuit 104 and the data line driving circuit 140 are described later.

Referring back to FIG. 1, the processing circuit 50 converts digital video signal "Video" supplied from an external higher level apparatus (not shown) into an analog data signal that is adapted for driving the display panel 10. The digital video signal "Video" is supplied in synchronization with vertical synchronizing signal $V_{sync}$, horizontal synchronizing signal $H_{sync}$, and dot clock signal $D_{clk}$. The processing circuit 50 also generates control signals for driving the display panel 10. The video signal "Video" is data defining an image to be displayed in the display region 100. In this embodiment, the video signal "Video" is supplied by using horizontal scanning lines (the number of lines) whose number is equal to or greater than "480", that is, the number of scanning lines in the display region 100. Accordingly, in the display region 100, part of the image defined by video signal "Video" is segmented and displayed.

The video signal "Video" may be supplied by using the number of horizontal lines that is less than "480". However, when the number of horizontal lines is less than "480", a portion having no display is generated in the display region 100, or a configuration for vertical scaling is needed.

For brevity of description, relationship between vertical synchronizing signal $V_{sync}$ and horizontal synchronizing signal $H_{sync}$ supplied from the external higher level apparatus, and driving timing of the display panel 10 is described with reference to FIG. 5.

Figure 5:
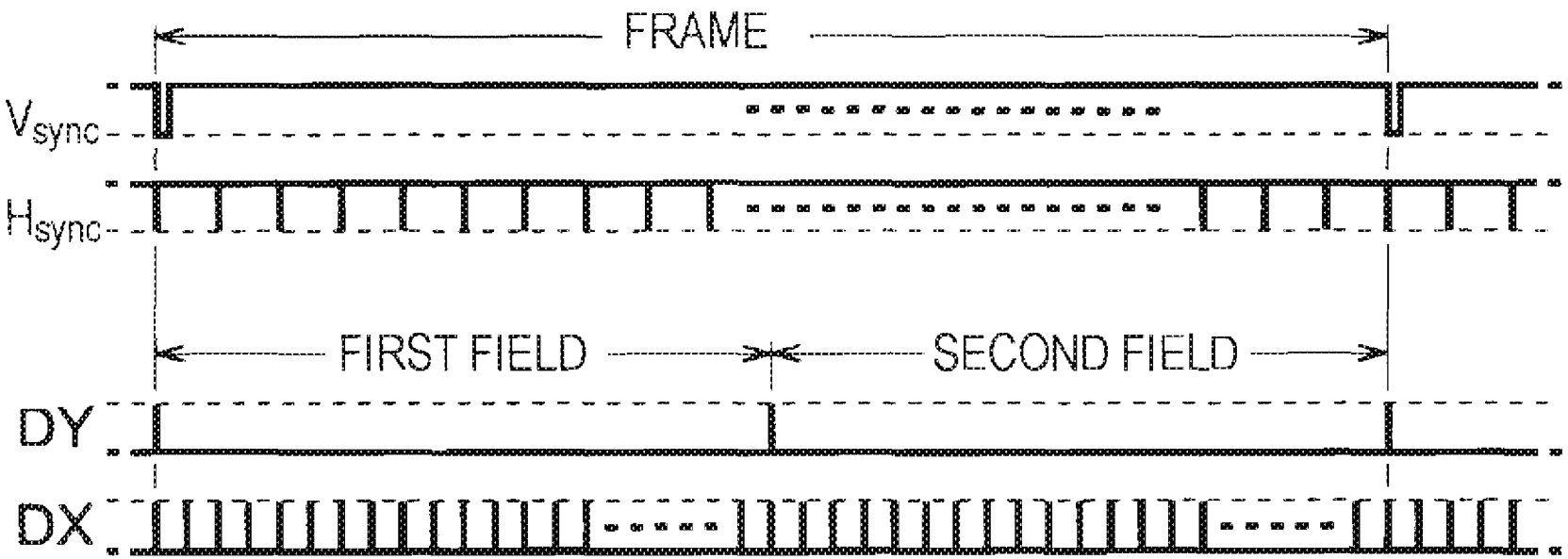
FIG. 5 is a timing chart showing an operation of the liquid crystal device in FIG. 1.

As shown in FIG. 5, vertical synchronizing signal $V_{sync}$ is pulses determining the start of vertical scanning of the image defined by video signal "Video", and horizontal synchronizing signal $H_{sync}$ is pulses determining the start of horizontal scanning. Therefore, at the time the vertical synchronizing signal $V_{sync}$ is supplied, video signal. "Video" is supplied for a frame, and, at the time the horizontal synchronizing signal $H_{sync}$ is supplied, video signal "Video" is supplied for a row. In this embodiment, vertical synchronizing signal $V_{sync}$ has a frequency of 60 Hz (a period of 16.7 milliseconds). Dot clock signal $D_{clk}$, which is not shown, defines a period in which video signal "Video" is supplied for a pixel.

In addition, since region scanning driving is performed in this embodiment, the period of a frame needed to display an image in the display region 100 is divided into two, first and second fields. Accordingly, a scanning control circuit 51 outputs start pulses DY defining the starts of the first and second fields, as described later. Also, correspondingly to horizontal synchronizing signal $H_{sync}$, the scanning control circuit 51 uses an internal PLL (phase-locked loop) to generate clock signal CLY that allows the scanning line driving circuit 130 to transfer start pulses DY so that clock signal CLY is output for 480 periods in one frame period. The scanning control circuit 51 further generates enable signals Enb1 and Enb2 for establishing synchronization with clock signal CLY. In a precise sense, start pulses DY are output so that a predetermined relationship with clock signal CLY can be maintained.

In addition, the scanning control circuit 51 outputs start pulses DX at the beginning of a period in which a scanning line in the display region 100 is selected, and generates clock signal CLX for transferring start pulses DX.

The processing circuit 50 in FIG. 1 includes the scanning control circuit 51, a counter 53, an addition/subtraction circuit 55, a register 57, a comparison circuit 59 (indicated by CMP), a video signal processing circuit 60, and a RAM (random access memory) 6A.

The counter 53 counts pulses of horizontal synchronizing signal $H_{sync}$, and outputs a maximum value, represented by CLc, among the counted values. The counted values are reset by vertical synchronizing signal $V_{sync}$. Accordingly, maximum value CLc among the values counted by the counter 53 represents the number of horizontal lines included in video signal "Video" in one vertical scanning period (frame).

The comparison circuit 59 compares the maximum value CLc output from the counter 53 to judge whether maximum value CLc is greater than value PLc, and outputs judgment signal F representing a result of the judgment.

The addition/subtraction circuit 55 adds "+2" or "−2" to value PLc, which is read from the register 57, in accordance with judgment signal F. In other words, the addition/subtraction circuit 55 increments (add) or decrements (subtracts) value PLc by "2". Specifically, when judgment signal F indicates that maximum value CLc is greater than value PLc, the addition/subtraction circuit 55 adds "2" to value PLc. When judgment signal F indicates that maximum value CLc is not greater than value PLc, the addition/subtraction circuit 55 subtracts "2" from value PLc.

The register 57 reads and outputs value PLc to the comparison circuit 59 under the control of the scanning control circuit 51, and stores, as new value PLc, a value obtained by adding/subtracting "2" to/from value PLc in the addition/subtraction circuit 55.

Timing that the comparison circuit 59 performs comparison is timing that the value counted by the counter 53 is maximum, that is, a time (the end of the period of one frame) immediately before vertical synchronizing signal $V_{sync}$ is output. With this timing, the scanning control circuit 51 controls reading of value PLc from the register 57, addition or subtraction of "2" on value PLc, and storing in the register 57 of the value obtained by the addition or subtraction. Thus, in this embodiment, when the number of horizontal lines included in video signal "Video" changes, the value PLc stored in the register 57 balances around the number of horizontal lines at the time the periods of plural frames have passed. For example, in a case in which the value PLc stored in the register 57 is "484", when the number of horizontal lies included in video signal. "Video" is switched to "490", the stored value PLc is incremented by "2" in such a manner that an initial value of "484" changes to "486", "486" changes to "488", and "488" changes to "490". Subsequently, the stored value PLc is repeatedly decremented and incremented by "2" in such a manner that it changes from "488" to "490", "490" changes to "488", and "488" changes to "490". In addition, in a case in which the value PLc stored in the register 57 is, for example, "490", when the number of horizontal lines included in video signal "Video" is switched to "484, the stored value PLc is decremented by "2" in such a manner that an initial value of "490" changes to "488", "488" changes to "486", "486" changes to "484", and "484" to "482. Subsequently, the stored value PLc is repeatedly incremented and decremented by "2" in such a manner that "486" changes to "486", "486" changes to "484" and "484" changes to "486".

As described above, since video signal "Video" is supplied by using the number of horizontal scanning lines (the number of lines) that is greater than "480" as the number of scanning lines in the display region 100, part of the image defined by video signal "Video" is segmented and displayed in the display region 100. Accordingly, on the basis of value PLc, the scanning control circuit 51 determines, in the image defined by video signal "Video", 480 rows that can be displayed in the display region 100.

When value PLc is "N", the scanning control circuit 51 determines to display, in the display region 100, of the image defined by video signal "Video", a portion for 480 rows obtained by subtracting (N−480) rows, that is, (N−480)/2 rows at each of the top and bottom. For example, when value PLc is "484", the scanning control circuit 51 determines to display, in the display region 100, a portion of the image for 480 rows obtained by subtracting 4 rows (2 rows at each of the top and bottom). In other words, in this embodiment, by regarding value PLc as the number of horizontal lines included in video signal. "Video", if video signal "Video" for one frame represents an image formed by the 1st to 484th rows, the scanning control circuit 51 determines to displays, in the 1st to 480th scanning lines in the display region 100, an image based on video signal "Video" and formed by the 3rd to 482nd rows obtained by subtracting the 1st, 2nd, 483rd, and 484th rows. Accordingly, rows (horizontal lines) of the image defined by video signal "Video" do not always correspond to rows in the display region 100. However, in the following descriptions in order to avoid unnecessary confusion, the rows in the display region 100 are used for description, unless otherwise noted.

Next, output timing of start pulses DY for the value PLc stored in the register 57 is described below.

When value PLc is "N", the scanning control circuit 51 outputs start pulses DY defining the start of the first field with timing that, in the image defined by video signal "Video", an image portion in the {(N−480)./2+1}-th row, that is, an image portion in the 1st row determined to be displayed in the display region 100, is scanned in the display region 100. The scanning line driving circuit 130, which is described later, is configured to sequentially shift start pulses DY with clock signal CLY. Thus, in a narrow sense, start pulses DY defining the start of the first field are output so as to determine output timing of scanning signal G1.

As described above, in this embodiment, the period of vertical synchronizing signal $V_{sync}$ is 16.7 milliseconds. Thus, the period of one frame in the case of driving the display region 100 is also 16.7 milliseconds. Accordingly, from a viewpoint of equalizing, for each pixel, a period in which vertical synchronizing signal $V_{sync}$ is positively held and a period in which vertical synchronizing signal $V_{sync}$ is negatively held, after 240 periods of clock signal CLY pass after start pulses DY defining the start of the first field are output, start pulses DY defining the start of the second field should be output so that the period of one frame is divided into two. However, since, as described above, clock signal CLY is generated on the basis of horizontal synchronizing signal $H_{sync}$, if the number of horizontal lines changes, that is, the horizontal scanning frequency based on horizontal synchronizing signal $H_{sync}$ changes, start pulses DY, which are output to maintain a predetermined relationship with clock signal CLY, move forward or backward for timing that the period of one frame is divided into two.

Accordingly, when value PLc increases by "2", the scanning control circuit 51 delays, for one period of clock signal CLY, start pulses DY defining the second field than timing that comes after 240 periods of clock signal CLY after start pulses DY defining the start of the first field. When value PLc decreases by "2", the scanning control circuit 51 advances the start pulses DY for one period of clock signal CLY.

The scanning control circuit 51 also changes generation of enable signals Enb1 and Enb2 correspondingly to supply of start pulses DY. Details of start pulses DY and enable signals Enb1 and Enb2 are described below in relationship with the scanning line driving circuit 130.

Under the control of the scanning control circuit 51, the video signal processing circuit 60 converts video signal "Video" into analog data signal $V_{id}$.

Specifically, in the first field, the video signal processing circuit 60 writes, into a FIFO (first-in first-out) line buffer, portions of video signal "Video" supplied from the external higher level apparatus, the portions corresponding to the 1st to 240th rows in the display region 100. After that, the video signal processing circuit 60 reads the written portions at a speed double the writing speed. The video signal processing circuit 60 converts the portions of video signal "Video" read at the double speed into, for example, a positive voltage, and outputs and writes the positive voltage as data signal $V_{id}$ in a field memory for the display panel 10. In addition, the video signal processing circuit 60 reads portions of video signal. "Video" from the field memory at the double speed, the portions corresponding to the 241st to 480th rows in the display region 100. The video signal processing circuit 60 converts the read portions into a negative voltage, and outputs the negative voltage as data signal $V_{id}$. The video signal processing circuit 60 executes, in the first field, this operation in the order of the 241st, 1st, 242nd, 2nd, 243rd, 3rd, . . . , 480th, and 240th rows.

In addition, in the second field, writes, into a FIFO line buffer, portions of video signal "Video" supplied from the external higher level apparatus, the portions corresponding to the 241st to 480th rows in the display region 100. After that, the video signal processing circuit 60 reads the written portions at a speed double the writing speed. The video signal processing circuit 60 converts the portions of video signal "Video" read at the double speed into, for example, a positive voltage, and outputs and writes the positive voltage as data signal $V_{id}$ in the field memory. In addition, the video signal processing circuit 60 reads portions of video signal "Video" from the field memory at the double speed, the portions corresponding to the 1st to 240th rows in the display region 100. The video signal processing circuit 60 converts the read portions into a negative voltage, and outputs the negative voltage as data signal $V_{id}$. The video signal processing circuit 60 executes, in the first field, this operation in the order of the 1st 241st, 2nd, 3rd, 243rd, . . . , 240th, and 480th rows.

Accordingly, data signal $V_{id}$ corresponding to the same pixel is supplied to the display panel 10 in each of the first and second fields. In one field, that is, the first field, data signal $V_{id}$ is a positive voltage obtained by converting video signal "Video" read from the line buffer, while, in the second field, a negative voltage obtained by converting video signal "Video" read from the field memory. The video signal processing circuit 60 uses the RAM 62 as the line buffer and the field memory, and is configured to perform writing and reading of video signal "Video".

In this embodiment, after the video signal "Video" supplied from the external higher level apparatus is temporarily stored in the line buffer, the video signal "Video" is read at a speed double the storing speed, and, after the period of a ½ frame (i.e., the period of one field) passes, the stored video signal "Video" is read again at the double speed. In a narrow sense, a delay occurs for first storing of video signal "Video" in the line buffer. Accordingly, the driving timing defined by start pulses DX and DY, etc., in the display panel 10 is delayed for timing defined by vertical synchronizing signal $V_{sync}$ (and horizontal synchronizing signal $H_{sync}$) and supplied from the external higher level apparatus. However, as shown in FIG. 5, it may be assumed that both match each other.

Next, the configuration of the scanning line driving circuit 130 is described below with reference to FIG. 4.

Figure 4:
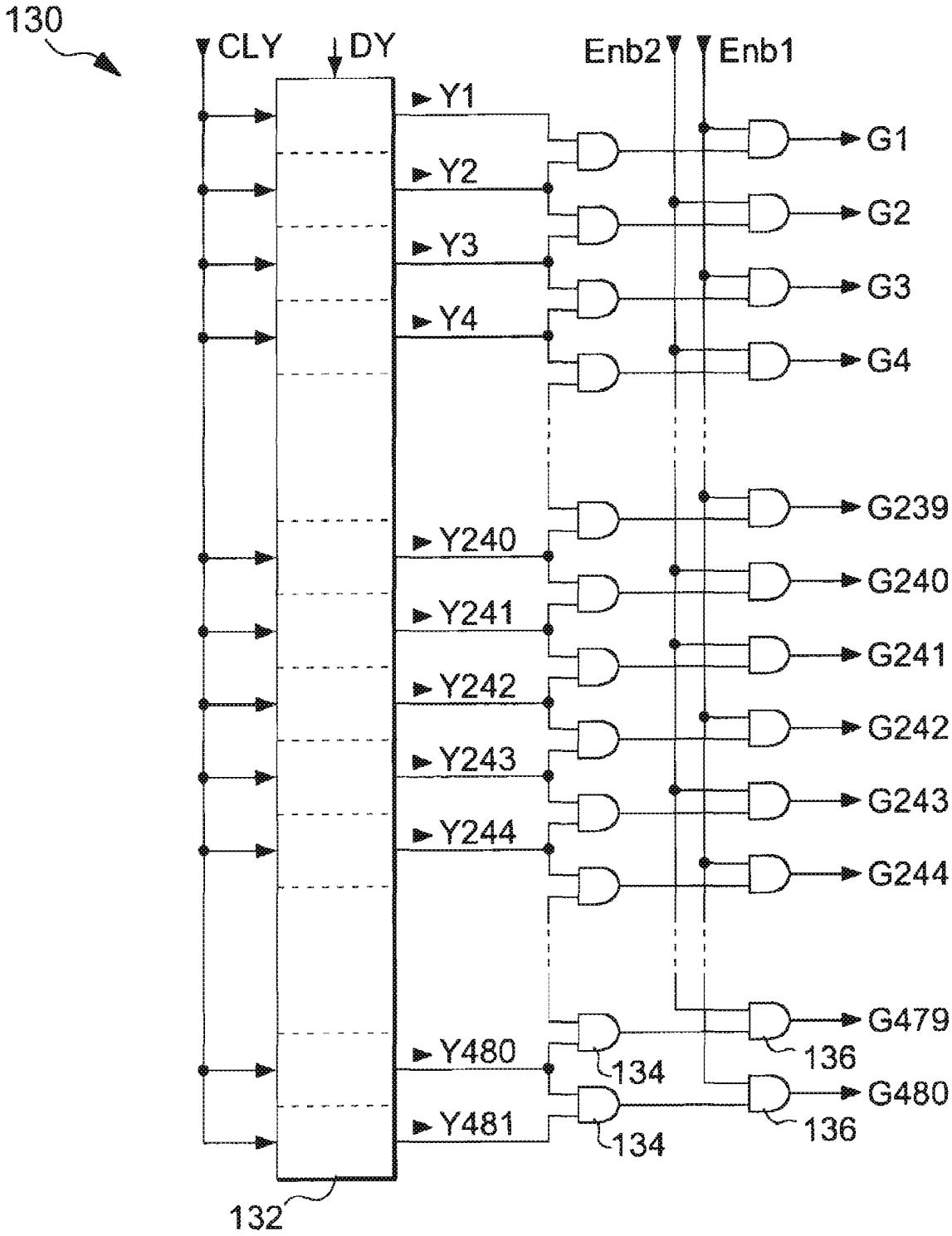
FIG. 4 is a circuit diagram showing the configuration of a scanning line driving circuit in the liquid crystal device in FIG. 1.

In FIG. 4, a shift register 132 includes transfer circuits having stages whose number is one more than "480" as the number of scanning lines in the display region 100. Whenever the logic level of clock signal CLY changes (rises and falls), the transfer circuits sequentially shift start pulses DY, and outputs, from stages, shift signals Y1, Y2, Y3, Y4, . . . , Y481.

Each AND circuit 134 outputs a logical multiplication signal representing the logical multiplication of adjacent shift signals. Each AND circuit 136 outputs a logical multiplication signal representing the logical multiplication of an output signal (logical multiplication signal) from one AND circuit 134 and one of enable signals Enb1 and Enb2.

An output of one AND circuit 136, which receives a logical multiplication signal based on shift signals (Y1 and Y2), serves as scanning signal G1, and an output of one AND circuit 136, which receives a logical multiplication signal based on shift signals (Y2 and Y3), serves as scanning signal G2. Similarly, outputs of the AND circuits 136 that are based on logical multiplication signals (Y3 and Y4), (Y4 and Y5), . . . , (Y480 and Y481) serve as scanning signals G3, G4, . . . , G480. These scanning signals are supplied to the scanning lines 112 in the 1st, 2nd, 3rd, 480th rows, respectively.

A relationship between the AND circuits 136 and enable signals Enb1 and Enb2 is as follows. Specifically, enable signal Enb1 is supplied to AND circuits 136 for supplying scanning signals to the scanning lines 112 in the 1st, 3rd, 5th, . . . , 239th rows in an upper half, and enable signal Enb2 is supplied to AND circuit 136 for supplying scanning signals to the scanning lines 112 in the 2nd, 4th, 6th, . . . , 240th rows in the upper half. Enable signal Enb2 is supplied to AND circuits 136 for supplying scanning signals to the scanning lines 112 in the 241st, 243rd, 245th, . . . , 479th rows in a lower half, and enable signal Enb1 is supplied to AND circuits 136 for supplying scanning signals to the scanning lines 112 in the 242nd, 244th, 246th, . . . , 480th rows in the lower half. In other words, arrangements for supplying enable signals Enb1 and Enb2 to the AND circuits 136 are symmetric between the upper half and the lower half.

Figure 6:
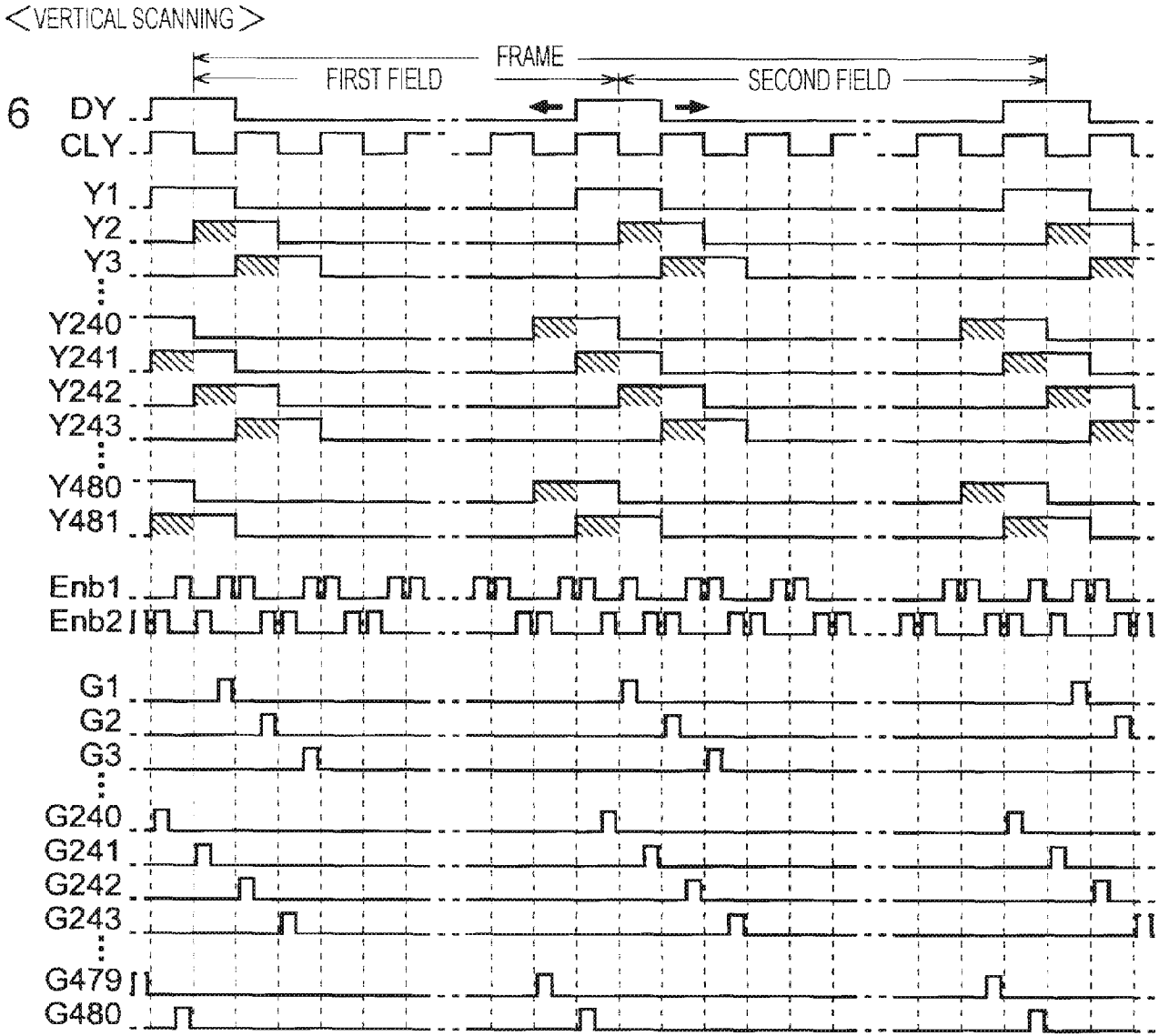
FIG. 6 is a timing chart showing vertical scanning in the liquid crystal device in FIG. 1.

If, in the scanning line driving circuit 130, the value PLc stored in the register 57 is not altered, as shown in FIG. 6, start pulses DY are supplied at the starts of the first and second fields obtained by equally dividing the period (16.7 milliseconds) of one frame, and clock signal CLY, whose one period is obtained by dividing the period of one period into "480", is supplied.

As described above, start pulses DY and clock signal CLY are supplied, whereby shift signal Y1 from the shift register 132 is substantially identical in waveform to start pulses DY. Subsequently, shift signals Y2, Y3, Y481 are respectively obtained by shifting start pulses DY (shift signal Y1) half the period of clock signal CLY. Accordingly, each logical multiplication signal that is obtained by each AND circuit 134 on the basis of adjacent shift signals is indicated by the hatched area of each shift signal because the logical multiplication signal is represented by a previous stage for a corresponding stage and the corresponding stage.

A pulse width of the logical multiplication signal that is obtained by each AND circuit 134 is narrowed on the basis of enable signal Enb1 or Enb2, and the obtained signal is output as a scanning signal.

Enable signals Eanb1 and Enb2 are the following pulse signals (H level). Specifically, as shown in FIG. 6, in the first field, before and after rise timing of clock signal CLY, two shots of enable signal Enb1 are exclusively output. Regarding enable signal Enab2, before and after fall timing of clock signal CLY, and after one shot of enable signal Enb1 is output after rise timing of clock signal CLY, two shots of enable signal Enab2 are exclusively output. In addition, in the second field, before and after fall timing of clock signal CLY, two shots of enable signal Enb1 are exclusively output. Regarding enable signal Enab2, before and after rise timing of clock signal CLY, after one shot of enable signal Enb1 is output after rise timing of clock signal CLY, two shots of enable signal Enab2 are exclusively output.

In the boundary between the first and second fields, before and after rise or fall timing of clock signal CLY, instead of two shots, only one shot of each of enable signals Enb1 and Enb2 is output.

In particularly, in this embodiment, on the basis of the value PLc stored in the register 57, start pulses DY defining the start of the first field is advanced and delay for one period of clock signal CLY. Thus, also the boundary between the first and second fields can be defined in enable signals Enb1 and Enb2 correspondingly to supply of start pulses DY.

As shown in FIG. 6, in the first field, the scanning signals come to have the H level in the order of G241, G1, G242, G2, G243, G3, . . . , G480, and G240, while, in the second field, the scanning signals come to have the H level in the order of G1, G241, G2, G242, G3, G243, . . . , G240, and G480.

Regarding these scanning signals, in terms of the rows of scanning lines 112 in the H level, in the first field: (1) first, the 241st row is selected; (2) the 1st row, which is upwardly detached 240 rows (corresponding to m) whose number is a half of "480" as the number of scanning lines from the 241st row, is selected; and (3) the 242nd row, which is downwardly detached 241 rows from the 1st row, By alternately repeating (2) and (3), the 2nd, 243rd, 3rd, . . . , 480th, and 240th rows are sequentially selected. In addition, in the second field: (4) first, the 1st row is selected; (5) the 241st row, which is downwardly detached 240 rows from the 1st row; and (6) the 2nd row, which is upwardly detached 239 rows from the 241st row, is selected. Subsequently, by alternately repeating (5) and (6), the 242nd, 3rd, 243rd, . . . , 240th, and 480th are sequentially selected.

In addition, the data line driving circuit 140 includes a sampling signal output circuit 142, and n-channel TFTs 146 for the data lines 114. The sampling signal output circuit 142 has a configuration in which the AND circuits 136 are omitted from the scanning line driving circuit 130. In other words, the sampling signal output circuit 142 includes transfer circuits having stages whose number is one more than the total number, 640, of the data lines 114. Whenever the logic level of clock signal CLX changes (rises and falls), the transfer circuits output shift signals obtained by sequentially shifting start pulses DX, and each AND circuit outputs a logical multiplication signal representing the logical multiplication of adjacent shift signals. Accordingly, logical multiplication signals are output as sampling signals S1, S2, S3, S4, . . . , S639, and S640.

Figure 7:
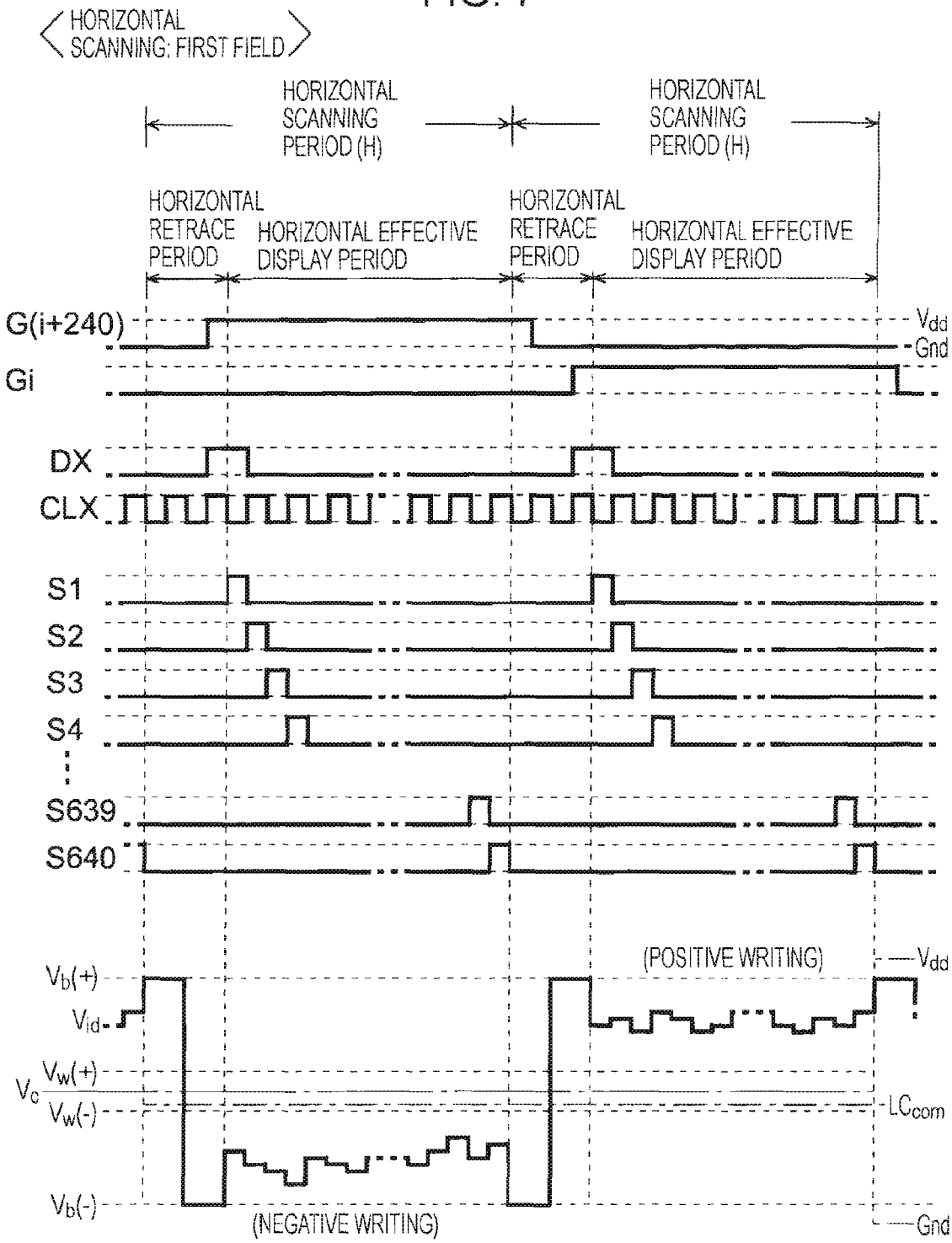
FIG. 7 is a timing chart showing horizontal scanning in the liquid crystal device in FIG. 1.

In this configuration, as shown in FIG. 7, sampling signal S1 corresponding to a logical multiplication signal is output with timing delayed for a half of the period of clock signal CLX from supply of start pulses DX. In addition, by sequentially shifting sampling signal S1 for a half of the period of clock signal CLX, sampling signals S2, S3, S4, . . . , S639, and S640 can be generated.

In FIG. 2, the TFTs 146 in the columns have sources connected in common to an image signal line 171 through which data signal $V_{id}$ is supplied, and drains connected to the data lines 114. Gates of the TFTs 146 are supplied with sampling signals. Accordingly, when sampling signal Sj corresponding to the j-th column is in the H level, a TFT 146 whose drain is connected to the data line 114 in the j-th column can sample data signal $V_{id}$ supplied to the image signal line 171 for the data line 114 in the j-th column.

Next, an operation of the liquid crystal device 1 is described below assuming the following case. Specifically, in the assumed case, the number of horizontal lines included in video signal "Video" supplied from the external higher level apparatus is constant over a plurality of frames, and value PLc stored in the register 57 is constant without adding/subtracting "2" to/from the value PLc stored in the register 57 by the addition/subtraction circuit 55.

In this case, as described above, on the basis of the value PLc stored in the register 57, the scanning control circuit 51 determines, in the image defined by video signal "Video", 480 rows that can be displayed in the display region 100. In other words, as described above, at the starts of the first and second fields obtained by equally dividing the period (16.7 milliseconds) of one frame, start pulses DY are supplied, and clock signal CLY whose one period is obtained by dividing the period of one frame into "480" is supplied.

As described above, in the first field, first, the scanning line in the 241st row is selected. Correspondingly to this selection, the video signal processing circuit 60 reads video signal "Video" corresponding to the 241st row stored in the field memory (the RAM 62) at the double speed. The video signal processing circuit 60 converts the read video signal "Video" into negative data signal $V_{id}$, and supplies the data signal $V_{id}$ to the image signal line 171 in the display region 100. Correspondingly to this supply, the sampling signal output circuit 142 is controlled so that sampling signals S1, S2, S3, S4, . . . , S640 sequentially come to have the H level.

Specifically, with timing that, in the 241st row, data signals $V_{id}$ corresponding to the pixels in the 1st, 2nd, 3rd, . . . , 640th columns are supplied to the image signal line 171, the scanning control circuit 51 controls the video signal processing circuit 60, the scanning line driving circuit 130, the sampling signal output circuit 142 so that sampling signals S1, S2, S3, . . . , S640 sequentially come to have the H level.

When sampling signal S1 is in H level, the TFT 146 in the first column is turned on. Thus, data signal $V_{id}$ which is supplied from the 171 and which corresponds to the pixel in the 241st row and the 1st column is sampled by the data line 114 in the 1st column. Similarly, when sampling signals S2, S3, . . . , S640 sequentially come to have the H level, the TFTs 146 in the 2nd, 3rd, . . . , 640th columns are sequentially turned on. Thus, data signals $V_{id}$ corresponding to the pixels in the 241st row and the 2nd, 3rd, . . . , 640th columns are sampled by the data lines 114 in the 2nd, 3rd, . . . , 640th columns.

In addition, when scanning signal G241 is in H level, all the TFTs 116 in the pixels 110 in the 241st row are turned on. Thus, the voltages of data signal $V_{id}$ sampled by the data lines 114 are directly applied to pixel electrodes 118. Accordingly, the liquid crystal capacitor 120 in each of the pixels in the 241 row and the 1st, 2nd, 3rd, . . . , 640th columns stores negative voltages corresponding to a grayscale level specified by video signal "Video".

Next to the 241st row, the scanning line in the 1st row is selected. Correspondingly to this selection, the video signal processing circuit 60 reads video signal "Video" corresponding to the 1st row stored in the line buffer (the RAM 62) at the double speed. The video signal processing circuit 60 converts the read video signal "Video" into positive data signal $V_{id}$, and supplies the data signal $V_{id}$ to the image signal line 171 in the display panel 10. Correspondingly to this supply the video signal processing circuit 60 controls the sampling signal output circuit 142 so that sampling signals S1, S2, S3, S4, . . . , S640 sequentially come to have the H level.

Therefore, a positive voltage corresponding to a grayscale level specified in video signal "Video" is stored in the liquid crystal capacitor 120 in each of the pixels in the 1st, 2nd, 3rd, . . . , and 640th columns in the 1st row.

Next the first row, the scanning lien in the 242nd row is selected. Correspondingly to this selection, the video signal processing circuit 60 reads video signal "Video" corresponding to the 241st row stored in the field memory (the RAM 62) at the double speed. The video signal processing circuit 60 converts the read video signal "Video" into negative data signal $V_{id}$, and supplies the data signal $V_{id}$ to the image signal line 171. Correspondingly to this supply, the sampling signal output circuit 142 is controlled so that sampling signals S1, S2, S3, S4, . . . , S640 sequentially come to have the H level. Therefore, a negative voltage corresponding to a grayscale level specified in video signal "Video" is stored in the liquid crystal capacitor 120 in each of the pixels in the 242nd row and the 1st, 2nd, 3rd, . . . , and 640th columns.

Since the scanning line in the 2nd row is selected next to the 242nd row, correspondingly to this selection, the video signal processing circuit 60 reads video signal "Video" corresponding to the 2nd row stored in the field memory (the RAM 62) at the double speed. The video signal processing circuit 60 converts the read video signal "Video" into positive data signal $V_{id}$, and supplies the data signal $V_{id}$ to the image signal line 171. Correspondingly to this supply, the sampling signal output circuit 142 is controlled so that sampling signals S1, S2, S3, S4, . . . , S640 sequentially come to have the H level. Therefore, a positive voltage corresponding to a grayscale level specified in video signal "Video" is stored in the liquid crystal capacitor 120 in each of the pixels in the 2nd row and the 1st, 2nd, 3rd, . . . , and 640th columns.

In the first field, subsequently, similar operations are repeated until the scanning lines in the 480th and 240th rows are selected. Accordingly, in the first field, a negative voltage corresponding to a grayscale level is written in each of the pixels in the 241st, 242nd, . . . , 480th rows, while a positive voltage corresponding to a grayscale level is written in each of the pixels in the 1st, 2nd, . . . , and 240th rows.

In the second field, as described above, scanning lines are selected in the order of the 1st, 241st, 2nd, 242nd, 3rd, 243rd, . . . , 240th, and 480th rows. Video signal Video corresponding to each of the 1st, 2nd, . . . , and 240th rows is read at the double speed from the field memory and is converted into a negative data signal, while video signal "Video" corresponding to each of the 241st, and 242nd, . . . , 480th rows is read from the line buffer and is written in a positive state.

Accordingly, in the second field, a negative voltage corresponding to a grayscale level is written in the liquid crystal capacitor 120 in each of the 1st, 2nd, 3rd, . . . , and 240th rows, while a positive voltage corresponding to a grayscale level is written in the liquid crystal capacitor 120 in each of the 241st, 242nd, 243rd, . . . , and 480th rows.

In this example, as shown in FIG. 7, the first field, the scanning line in the (i+240)-th row is selected before the scanning line in the i-th row is selected. Thus, scanning signals G(i+1) and Gi come to have the H level in the order given. In the case of negative writing, data signal $V_{id}$ has a lower voltage for a time based on a pixel grayscale level in the range from voltage $V_c$ from voltage $V_b$ (−), which corresponds to black, to voltage $V_w$ (−), which corresponds to white. In the case of positive writing, data signal $V_{id}$ has a higher voltage for a time based on a pixel grayscale level from reference voltage $V_c$ in the range from voltage $V_b$ (+), which corresponds to black (minimum grayscale level), to voltage $V_w$ (+), which corresponds to white (maximum grayscale level).

In addition, logic levels of scanning and sampling signals include an H (high) level and an L (low) level. The H level is voltage $V_{dd}$, and the L level is a reference voltage in this embodiment that is ground potential Gnd. However, a writing polarity in this embodiment is a writing polarity to the liquid crystal capacitor 120. Thus, a criterion for positiveness and negativeness is not ground potential Gnd but voltage $V_c$.

In this embodiment, voltage $V_c$ is set to be slightly higher than voltage $LC_{com}$ applied to the common electrode 108. This is because parasitic capacitance between the gate and drain of the TFT 116 causes occurrence of a phenomenon (called pushdown, punch-through, field-through, etc.) in which the potential of the drain (the pixel electrode 118) lowers when the state changes from on to off. Although the liquid crystal capacitor 120 should be driven by AC driving in order to prevent deterioration in liquid crystal, when AC driving is performed by using, as a writing polarity reference, voltage $LC_{com}$ applied to the common electrode 108, due to pushdown, an effective voltage caused by negative writing of the liquid crystal capacitor 120 is slightly greater than an effective voltage caused by positive writing (when the TFT 116 is of an n-channel type) Accordingly, by setting reference voltage $V_c$ for writing polarity to be higher than voltage $LC_{com}$ of the common electrode 108, an effect of the pushdown can be offset.

The vertical scale of tile data line shown in FIG. 7 is shown enlarged than the other voltage waveforms.

Figure 8:
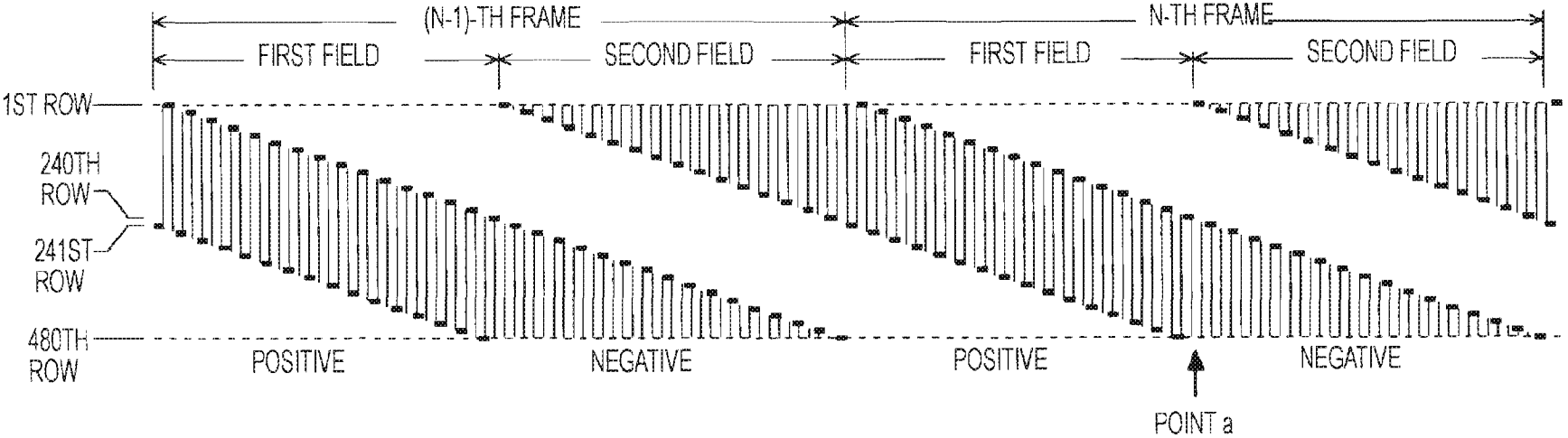
FIG. 8 is an illustration of writing in the liquid crystal device in FIG. 1.

This writing operation is described with reference to FIG. 8. FIG. 8 is an illustration of states of writing in rows in this embodiment, with an elapse of time over consecutive frames. Instead of showing writing in all the 1st to 480th rows FIG. 8 shows a simplified form in which the rows are reduced.

As shown in FIG. 8, in this embodiment, in the first field, negative writing is performed in each of the pixels in the 241st, 242nd, 243rd, . . . , and 480th rows, while positive writing is performed in each of the pixels in the 1st, 2nd, 3rd, . . . , and 480th rows, and the written voltages are held until the next writing is performed. In the second field, negative writing is performed in each of the pixels in the 1st, 2nd, 3rd, . . . , and 240th rows, while positive writing Is performed in each of the 241st, 242nd, 243rd, . . . , and 480th rows, and the written voltages are similarly held.

Accordingly, with any timing, in any column, the percentages of pixels holding positive voltages and pixels holding negative voltages are each 50 percent. Therefore, the polarity of the data line 114 during the voltage holding period is prevented from being biased. This prevents display nonuniformity because, in each row, the amount of leak of charge written in the pixel electrode 118 through the TFT 116 in its off-state is uniform.

In addition, in this embodiment, regarding timing that one row is selected, a pixel in the row and a pixel in an upper row next to the one row are opposite in writing polarity. However, the other pixels are identical in writing polarity. Therefore, display quality due to disclination (misorientation) can be prevented from deteriorating.

The foregoing describes an operation in a case in which value PLc stored in the register 57 is not changed. Accordingly, next, problems in the case in which value PLc stored in the register 571 is not changed are discussed below.

Figure 9:
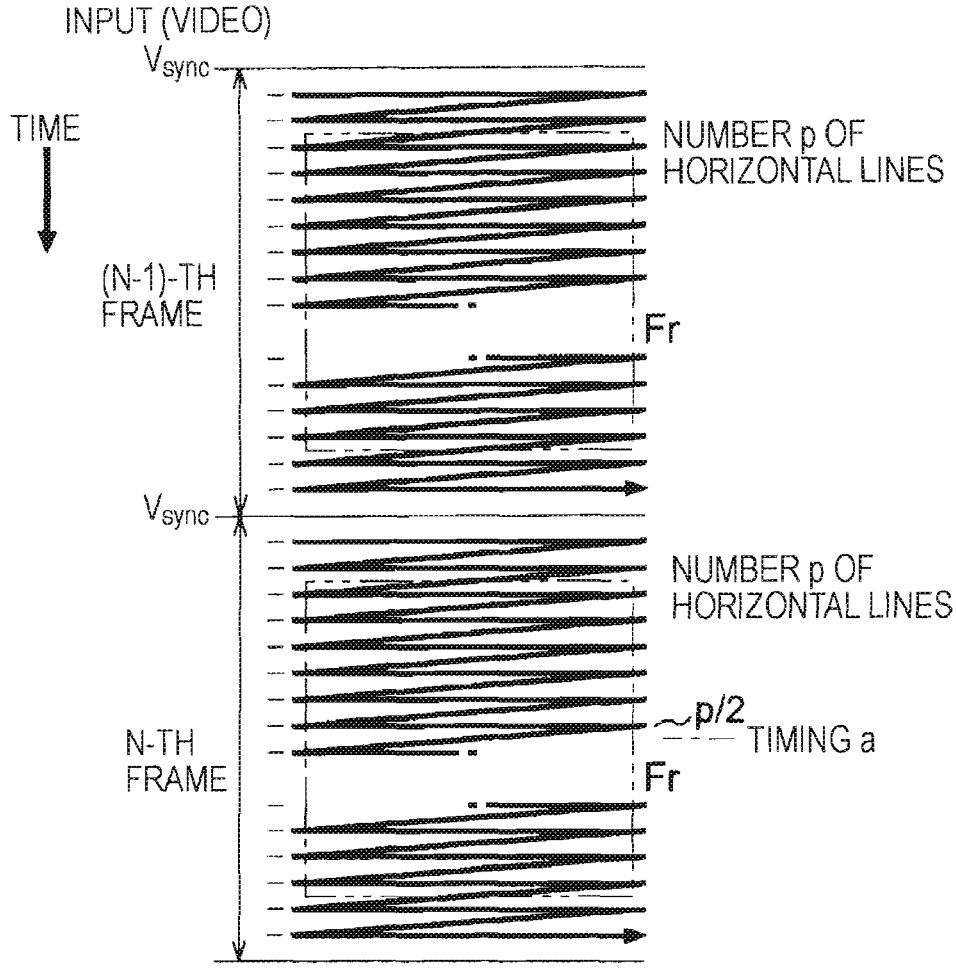
FIG. 9 is an illustration of an operation of altering the number of lines in the liquid crystal device in FIG. 1.

As showman in FIG. 9, when there is no change in the number p of horizontal lines included in video signal "Video", video signal "Video" is segmented into 480 rows as indicated by frame Fr, and the 480 rows are displayed in the display region 100. At this time, the scanning control circuit 51 performs scaling on clock signal CLY, etc., so that central timing of frame Fr, that is, timing "a" immediately after supply in the (p/2)-th row in the image defined by video signal "Video", serves as the boundary between the first and second fields.

Figure 10:
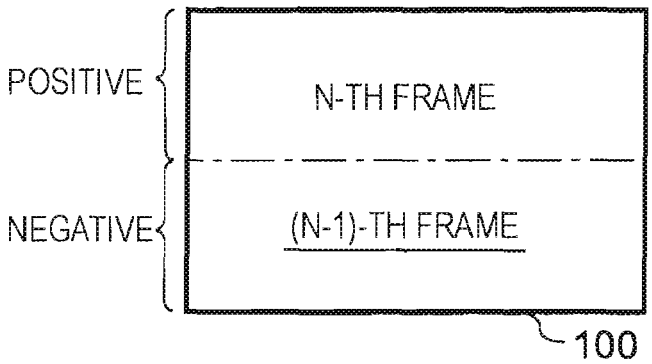
FIG. 10 is an illustration of an operation of altering the number of lines in the liquid crystal device in FIG. 1.

Accordingly, if the number p of horizontal lines is constant over a plurality of frames in the display region 100, as shown in FIG. 10, at timing "a", positive voltages based on video signal "Video" supplied in an N-th frame are written in the pixels in the 1st to 240th rows. In addition, negative voltages based on video signal "Video" in the previous (N−1)-th frame from the N-th frame are written in the pixels in the 241st to 480th rows.

Since scaling is performed so th-at timing "a" serves as the boundary between the first and second fields, the period in which the positive voltage is held and the period in which the negative voltage is held are equal to each other. Thus, no DC voltage is applied to the liquid crystal capacitor 120.

Figure 11:
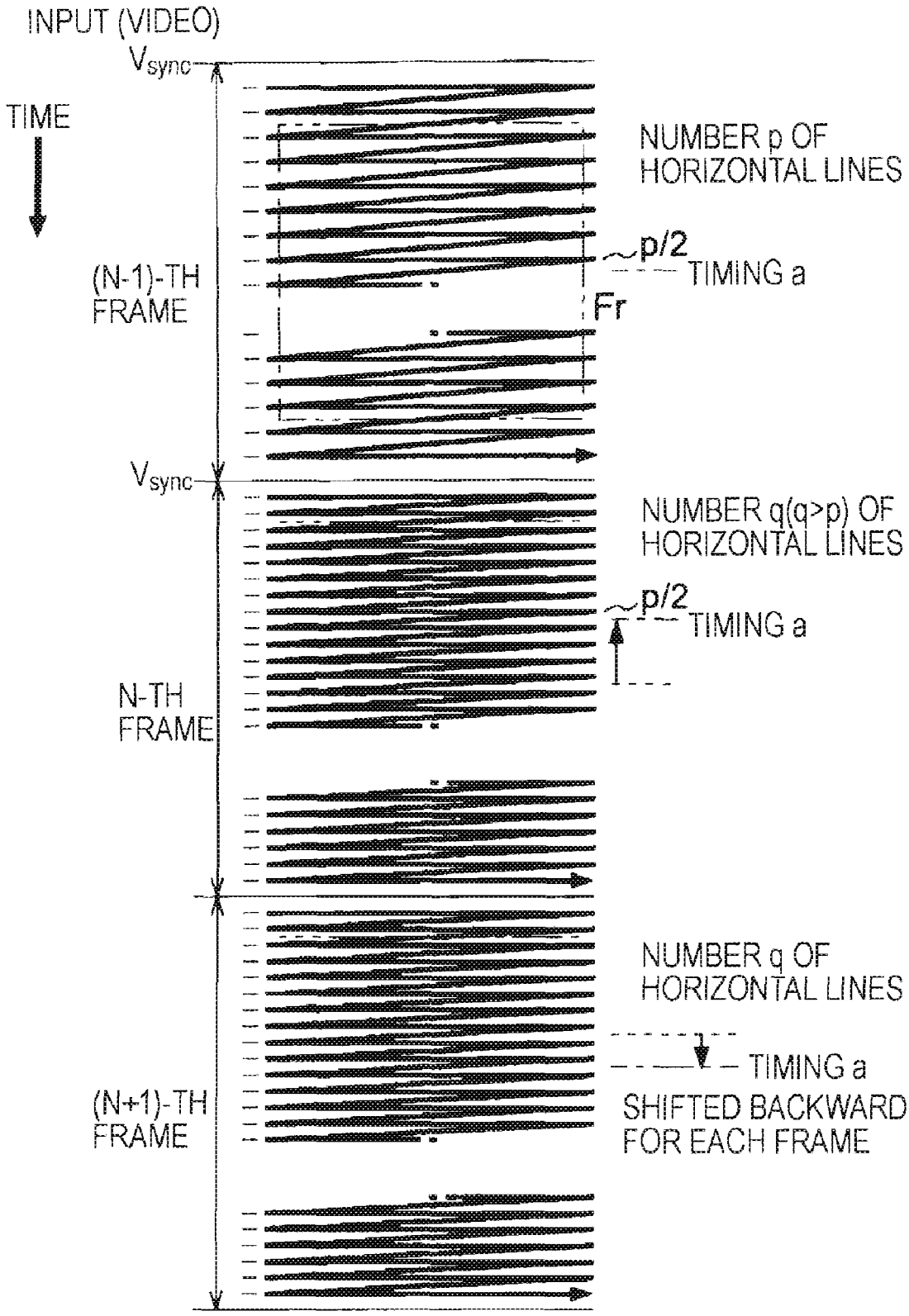
FIG. 11 is an illustration of an operation of altering the number of lines in the liquid crystal device in FIG. 1.

However, when the number of horizontal lines included in video signal "Video" is changed from p to q from the (N−1)-th frame to the N-th frame, as shown in FIG. 11 for a reason such as switching of image sources by a higher level control circuit (FIG. 11 shows a case in which the number of horizontal lines is increased), a horizontal scanning period (corresponding to a line interval in FIG. 11) defined by horizontal synchronizing signal $H_{sync}$ is changed.

In this case, in the N frame, which is located immediately after the number of horizontal lines is changed, the next vertical synchronizing signal $V_{sync}$ has not been input, so that the number q of horizontal lines included in vertical synchronizing signal $V_{sync}$ cannot be detected. Thus, the scanning control circuit 51 processes video signal "Video" in the N-th and subsequent frames, regarding video signal "Video" as having the number p of horizontal lines in the previous (N−1)-th frame. Therefore, when the number of horizontal lines increases, timing "a" immediately after supply in the (p/2)-th row in the image defined by video signal "Video" is shifted temporally forward from the center of the frame period, while, when the number of horizontal lines decreases, timing "a" is shifted temporally backward (not shown) from the center of the frame period.

If the center of the frame does not match the boundary between the first and second fields, the period in which the positive voltage is held and the period in which the negative voltage is held are not equal to each other, thus causing a problem in that a DC voltage is applied to the liquid crystal capacitor 120.

Until, after the number of horizontal lines is changed, an internal PLL becomes stable depending on the changed number q of horizontal lines, that is, until scaling on clock signal CLY, etc., is performed so that, in the image defined by video signal "Video", timing "a" immediately after supply in (q/2)-th row serves as the boundary between the first and second fields, several seconds are needed depending on PLL performance. When this converted into its equivalent number of frames, the number of frames exceeds 100. Thus, application of the DC voltage to the liquid crystal capacitor 120 cannot be ignored.

In addition, when the scanning control circuit 51 controls each portion, regarding maximum value CLc (counted in the (N−1)-th frame) by the counter 53 as the number of horizontal lines in video signal "Video" supplied to the next N-th frame, if the number of horizontal lines in video signal "Video" is unstable, a difference between value CLc counted by the counter 53 and the number of horizontal lines in video signal "Video" supplied to the next frame continues, so that the DC voltage can easily be applied to the liquid crystal capacitor 120. Accordingly, this state may not be said to be preferable.

To cope with this problem, in this embodiment, when value PLc stored in the register 57 increases by "2", start pulses DY defining the start of the second field are shifted one period backward for clock signal CLY before being output, while, when value PLc decreases by "2", start pulses DY defining the start of the second field are shifted one period forward for clock signal CLY before being output.

Specifically, the number (maximum value CLc counted by the counter 53) of horizontal lines included in video signal "Video" in the N-th frame is greater than the number (value PLc stored in the register 57) of horizontal lines in the previous (N−1)-th frame, "2" is added to value PLc by the addition/subtraction circuit 55 before value PLc is stored in the register 57. Accordingly, as shown in FIG. 11, in the next frame (N+1)-th frame, start pulses DY defining the start of the second field are shifted one period backward for clock signal CLY by the scanning control circuit 51.

Alternatively, when the number of horizontal lines included in video signal "Video" in the N-th frame is not greater than the number of horizontal lines of horizontal lines in the (N−1)-th frame, "2" is subtracted from value PLc before value PLc is stored in the register 57. Accordingly, in the next (N+1)-th frame, start pulses DY defining the start of the second field are shifted one period forward (not shown) for clock signal CLY by the scanning control circuit 51.

In this embodiment, when the number of horizontal lines included in video signal "Video" is changed to number q, "2" is added to or subtracted from value PLc stored in the register 57 at the end of the frame period. Thus, after the time passes or a plurality of frames, value PLc becomes stable around number q, as described above. Therefore, after value PLc becomes stable, the changed number of horizontal lines is the changed number q in terms of a temporal average. Thus, the periods of the first and second fields are equal in terms of a temporal average.

Since value PLc increases or decreases by "2" in one frame, if a changed number of horizontal lines is approximately 50, value PLc becomes stable in 25 frames, whose number is a half of the number 50. Thus, the change can be followed faster than waiting for the internal PLL to be stable.

Furthermore, even if the number of horizontal lines included in video signal "Video" after change varies around number q, value PLc changes so as to be a value obtained by averaging varying numbers of horizontal lines. Thus the periods of the first and second fields are similarly equal in length in terms of a temporal average.

Accordingly, in this embodiment, application of the DC component to liquid crystal is eliminated, whereby sticking can be prevented.

In this embodiment, the comparison circuit 59 determines whether or not maximum value CLc counted by the counter 53 is greater than value PLc read from the register 57. If maximum value CLc is greater, "2" is added to value PLc read from the register 57 before value PLc is set in the register 57 again, while, if maximum value CLc is not greater, "2" is subtracted from value PLc read from the register 57 before value PLc is set in the register 57 again. However, the comparison circuit 59 may determine whether or not maximum value CLc is not less than value PLc read from the register 57, and, if maximum value CLc is not less, "2" may be added to value PLc read from the register 57 before value PLc is set in the register 57 again, while, if maximum value CLc is less than value PLc, "2" may be subtracted from value PLc before value PLc is set in the register 57 again.

Furthermore, the comparison circuit 59 may determine, in three manners, whether or not maximum value CLc is not less than value PLc, whether or not maximum value CLc is equal to value PLc, and whether or not maximum value CLc is less than value PLc. If maximum value CLc is equal, value PLc may be returned and stored in the register 57 without performing addition/subtraction (adding zero) to/from value PLc.

The reason that, in the above-described embodiment, the addition/subtraction circuit 55 adds/subtracts "2" to/from value PLc is that, when start pulses DY are shifted one period forward or backward for clock signal CLY, the second field starts forward or backward or two scanning lines (see FIG. 6).

Therefore, if the relationship shown in FIG. 6 that is, a relationship in which, when start pulses DY are shifted, addition or subtraction is performed by scanning lines (the number of horizontal lines) moved forward or backward, is maintained among the addition/subtraction circuit 55, the scanning control circuit 51, and the scanning line driving circuit 130, a number other than "2" may be used.

The above-described embodiment employs a dot-sequential configuration in which, when a scanning signal corresponding to one scanning line 112 is in the H level, data signal $V_{id}$ corresponding to each of the pixels in the 1st to 480th columns on the scanning line is sequentially supplied. However, the above-described embodiment may use, at the same time, so-called "phase expansion (also called serial-to-parallel conversion) driving" (see JP-A-2000-112437) in which a data signal is temporally expanded "n" times (n represents an integer not less than 2) and is supplied to "n" image signal lines. In addition, the above-described embodiment may use a so-called "line-sequential configuration", in which data signals are simultaneously supplied to all the data lines 114.

The above-described embodiment performs negative writing in the 241st and subsequent rows in the first field, positive writing in the 1st and subsequent rows in the second field, and positive writing in the 241st and subsequent rows. However, the writing polarities may be opposite.

The above-described embodiment uses a normally white mode in which white is displayed in a state with no voltage applied. A normally black mode in which black is displayed in a stage with no voltage applied may be used. In addition, by using three pixels corresponding to red, green, and blue to form each dot, color display may be performed. The display region 100 is not limited to a transparent type, but may be of a reflective type, and of a semi-transparent semi-reflective type between both types.

Figure 12:
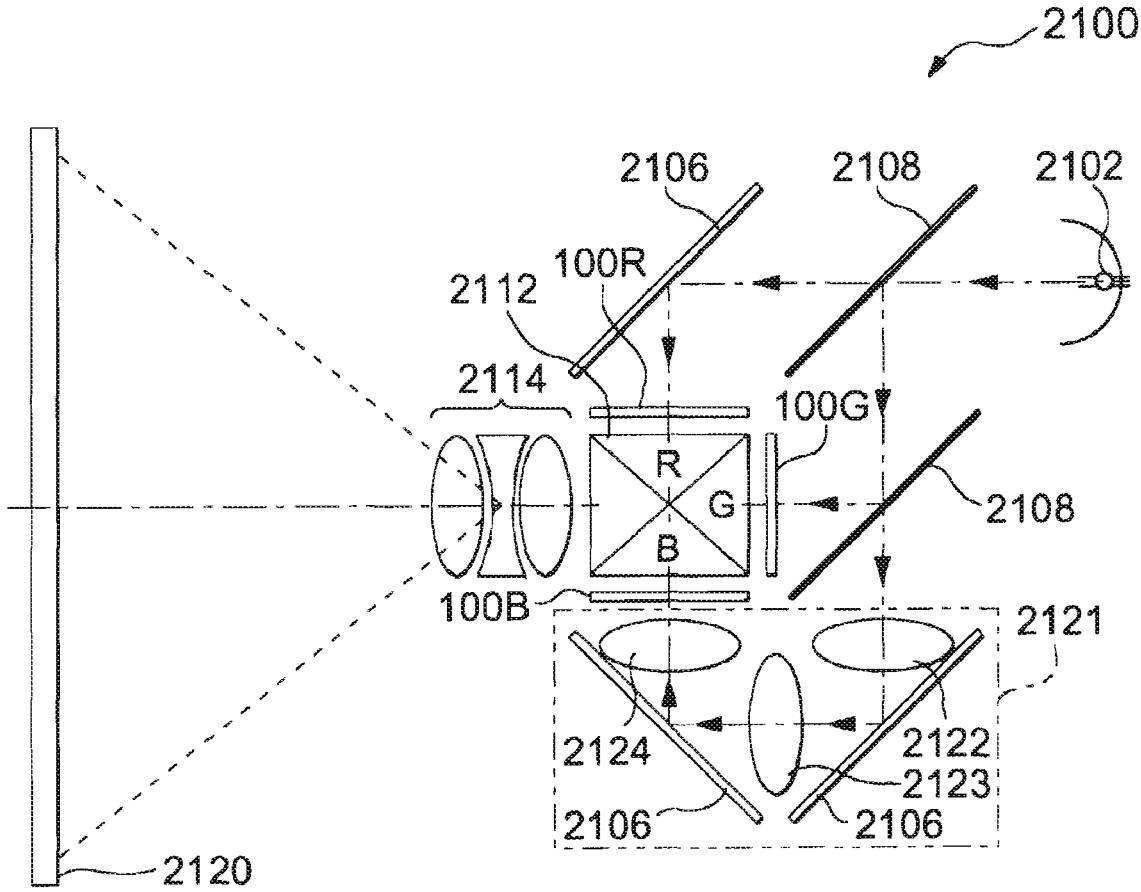
FIG. 12 is a sectional view showing a projector using the liquid crystal device in FIG. 1.

Next, an example of an electronic apparatus using the liquid crystal device according to the above-described embodiment is described below. FIG. 12 is a plan view showing the configuration of a three-plate projector 2100 using the above-described liquid crystal device 1 as each of light bulbs.

In the projector 2100, light that is incident on the light bulb is separated by three mirrors 2106 and two dichroic mirrors 2108 into three primary colors, R (red), G (green), and B (blue) rays. The R, G, and B rays are conducted into light bulbs 100R, 100G, and 100B. Since the B ray is longer in optical path than the other rays, in order that a loss caused by the longer optical path may be prevented, the B ray is conducted through a relay lens system 2121 including an incident lens 2122, a relay lens 2123, and an outgoing lens 2124.

The light bulbs 100R, 100G, and 100B are similar in configuration to the display region 100 of the liquid crystal device 1 according to the above-described embodiment. The light bulbs 100R, 100G, and 100B are driven by data items supplied from a high level external apparatus (not shown), the data items corresponding to the R, G, and B rays.

Rays modulated by the light bulbs 100R, 100G, and 100B are incident on a dichroic prism 2112 in three directions. In the dichroic prism 2112, the R and B rays are reflected 90 degrees, while the C ray travels straight. Therefore, images based on the R, G, and B rays are combined, and the combined image is projected normally enlarged, whereby a color image is displayed on a screen 2120.

Transmission images from the light bulbs 100R and 100B are reflected by the dichroic prism 2112 before being projected, while a transmission image from the light bulb 100 is directly projected. Thus, a horizontal scanning direction determined by each of the light bulbs 100R and 100B is reverse to a horizontal scanning direction determined by the light bulb 100G, whereby a mirror reversed image can be displayed.

In addition to the projector 2100 described with reference to FIG. 12, electronic apparatuses include direct view apparatuses, for example, personal computers, television sets, video camera monitors, car navigation apparatuses, pagers, electronic notebooks, calculators, word processors, work stations, videophones, POS (point of sale) terminals, digital still cameras, and devices with touch panels. Definitely, a liquid crystal device according to an embodiment of the invention is applicable to these electronic apparatuses of various types.

The entire disclosure of Japanese Patent Application Nos: 2006-119125, filed Apr. 24, 2006 and 2006-171523, filed Jun. 21, 2006 are expressly incorporated by reference herein

What is claimed is:

1. A liquid-crystal-device control circuit comprising:

a plurality of pixels corresponding to intersections between scanning lines in a plurality of rows and data lines in a plurality of columns, each pixel having a grayscale level based on a data signal supplied to one data line when each scanning line is selected;

a scanning line driving circuit that, in first and second fields obtained by dividing the period of a frame, selects the plurality of scanning lines by performing:

in one field of the first and second fields, first selection for selecting a scanning line in one row, the selected scanning line serving as a base;

second selection for selecting a scanning line which is m rows away in one direction from the scanning line selected in an immediately preceding selection, where m represents an integer not less than 2;

third selection for selecting a scanning line which is (m+1) rows away in an opposite direction from the scanning line selected in the second selection; and alternate repetition of the second selection and the third selection; and in the other field of the first and second fields, fourth selection for selecting a scanning line in one row, the selected scanning line serving as a base;

fifth selection for selecting a scanning line which is m rows in the opposite direction from the scanning line selected in an immediately preceding selection;

sixth selection for selecting a scanning line which is (m−1) rows away in the one direction from the scanning line selected in the fifth selection; and alternate repetition of the fifth selection and the sixth selection;

a data-line driving circuit which supplies, to the data lines in the plurality of columns, a data signal having a voltage based on a grayscale level of one pixel corresponding to each scanning line selected, and in which, when the scanning line is selected in each of the first selection, the third selection, and the fifth selection, the voltage of the data signal is set to be higher or lower than a predetermined reference voltage, and, when the scanning line is selected in each of the second selection, the fourth selection, and the sixth selection, the voltage of the data signal is set to be higher or lower than the predetermined reference voltage;

a counter that counts the number of horizontal lines included in a video signal supplied correspondingly to a region broader than pixels corresponding to the scanning lines in the plurality of rows;

a determination circuit that determines which is greater between the number of horizontal lines counted by the counter and a value stored in a predetermined register;

an addition/subtraction circuit that, depending on a result of determination by the determination circuit, adds a predetermined number to or subtracts the predetermined number from the value stored in the register; and a scanning control circuit which stores the value obtained by the addition/subtraction circuit in the register, and which defines start timing of the second field on the basis of the value stored in the register.

2. The liquid-crystal-device control circuit according to claim 1, wherein, when the determination circuit determines that the number of horizontal lines counted by the counter is greater than the value stored in the register, the addition/subtraction circuit adds the predetermined number to the value stored in the register, and, when the determination circuit determines that the number of horizontal lines counted by the counter is less than the value stored in the register, the addition/subtraction circuit subtracts the predetermined number from the value stored in the register.

3. The liquid-crystal-device control circuit according to claim 2, wherein, when the number of horizontal lines counted by the counter is equal to the value stored in the register, the addition/subtraction circuit maintains the value stored in the register.

4. The liquid-crystal-device control circuit according to claim 2, wherein, when the predetermined number is added to the value stored in the register, the scanning control circuit delays the start timing of the second field than predetermined timing, and, when the predetermined number is subtracted from the value stored in the register, the scanning control circuit advances the start timing of the second field than the predetermined timing.

5. The liquid-crystal-device control circuit according to claim 4, wherein:

the scanning line driving circuit selects the scanning lines in the plurality of rows on the basis of a shift signal obtained by shifting start pulses on the basis of a clock signal; and the scanning control circuit defines the start timing of the second field by delaying or advancing supply timing of the start pulses for the clock signal.

6. A liquid crystal device comprising:

a plurality of pixels corresponding to intersections between scanning lines in a plurality of rows and data lines in a plurality of columns, each pixel having a grayscale level based on a data signal supplied to one data line when each scanning line is selected;

a scanning line driving circuit that, in first and second fields obtained by dividing the period of a frame, selects the plurality of scanning lines by performing:

in one field of the first and second fields, first selection for selecting a scanning line in one row, the selected scanning line serving as a base;

second selection for selecting a scanning line which is m rows away in one direction from the scanning line selected in an immediately preceding selection, where m represents an integer not less than 2;

third selection for selecting a scanning line which is (m+1) rows away in an opposite direction from the scanning line selected in the second selection; and alternate repetition of the second selection and the third selection; and in the other field of the first and second fields, fourth selection for selecting a scanning line in one row, the selected scanning line serving as a base;

fifth selection for selecting a scanning line which is m rows in the opposite direction from the scanning line selected in an immediately preceding selection;

sixth selection for selecting a scanning line which is (m−1) rows away in the one direction from the scanning line selected in the fifth selection; and alternate repetition of the fifth selection and the sixth selection;

a data-line driving circuit which supplies, to the data lines in the plurality of columns, a data signal having a voltage based on a grayscale level of one pixel corresponding to each scanning line selected, and in which, when the scanning line is selected in each of the first selection, the third selection, and the fifth selection, the voltage of the data signal is set to be higher or lower than a predetermined reference voltage, and, when the scanning line is selected in each of the second selection, the fourth selection, and the sixth selection, the voltage of the data signal is set to be higher or lower than the predetermined reference voltage;

a counter that counts the number of horizontal lines included in a video signal supplied correspondingly to a region broader than pixels corresponding to the scanning lines in the plurality of rows;

a determination circuit that determines which is greater between the number of horizontal lines counted by the counter and a value stored in a predetermined register;

an addition/subtraction circuit that, depending on a result of determination by the determination circuit, adds a predetermined number to or subtracts the predetermined number from the value stored in the register; and a scanning control circuit which stores the value obtained by the addition/subtraction circuit in the register, and which defines start timing of the second field on the basis of the value stored in the register.

7. An electronic apparatus including the liquid crystal device as set forth in claim 6.

* * * * *